US007784901B2

(12) United States Patent
Tamaki et al.

(10) Patent No.: US 7,784,901 B2
(45) Date of Patent: Aug. 31, 2010

(54) CARRIAGE DRIVING APPARATUS AND IMAGE FORMING APPARATUS

(75) Inventors: Shuichi Tamaki, Nagoya (JP); Kenji Samoto, Nagoya (JP)

(73) Assignee: Brother Kogyo Kabushi Kaisha, Nagoya-shi, Aichi-ken (JP)

( * ) Notice: Subject to any disclaimer, the term of this patent is extended or adjusted under 35 U.S.C. 154(b) by 916 days.

(21) Appl. No.: 11/616,698

(22) Filed: Dec. 27, 2006

(65) Prior Publication Data

US 2007/0146420 A1 Jun. 28, 2007

(30) Foreign Application Priority Data

Dec. 28, 2005 (JP) ..... 2005-380148

(51) Int. Cl.
*B41J 23/00* (2006.01)

(52) U.S. Cl. ..... 347/37

(58) Field of Classification Search ..... 347/37; 400/352

See application file for complete search history.

(56) References Cited

U.S. PATENT DOCUMENTS

2005/0195242 A1 9/2005 Samoto et al.

FOREIGN PATENT DOCUMENTS

| | | | |
|---|---|---|---|
| JP | 2002-240251 | A | 8/2002 |
| JP | 2002-361901 | A | 12/2002 |
| JP | 2004-160871 | A | 6/2004 |
| JP | 2002-246907 | A | 9/2005 |

*Primary Examiner*—Shih-wen Hsieh
(74) *Attorney, Agent, or Firm*—Baker Botts L.L.P.

(57) ABSTRACT

There is provided a carriage driving apparatus having a first guide member and a second guide member that extend in parallel and are adjacent to each other, and a carriage disposed between the first guide member and the second guide member that queue side by side, the carriage being capable of reciprocative movement in a extending direction of the guide members by being guided by the guide members. The carriage driving apparatus including a detection strip arranged along the extending direction for detecting the position of the carriage in the extending direction, and first extending portion and second extending portion mounted respectively at one end and another end of the first guide member and extending respectively from each end so as to be perpendicular to the extending direction and a queuing direction of the guide members, the extending portions supporting the detection strip.

17 Claims, 5 Drawing Sheets

CARRIAGE DRIVING APPARATUS AND IMAGE FORMING APPARATUS

CROSS-REFERENCE OF RELATED APPLICATION

This nonprovisional application claims priority under 35 U.S.C. §119(a) on Patent Application No. 2005-380148 in Japan on Dec. 28, 2005, the entire contents of which are hereby incorporated by reference.

BACKGROUND

The present invention relates to a carriage driving apparatus provided with a carriage that makes a reciprocating movement in a scanning direction.

The applicant has proposed a carriage driving apparatus provided with a carriage that makes a reciprocating movement in a scanning direction in order to realize downsizing an image forming apparatus.

In the carriage driving apparatus, a carriage (5) is disposed between a pair of guide members (first and second guide members 22 and 23) extending respectively in the same direction, wherein the carriage makes a reciprocating movement in the direction of extending the guide members, defined as the scanning direction (see Japanese Patent Application Laid-Open No. 2005-246907 (e.g., FIG. 13)).

BRIEF SUMMARY

In the above-mentioned carriage driving apparatus, the current position (displacement) of the carriage is generally specified by an encoder strip (detection strip) attached to one of the guide members. In recent years, it has been demanded that the mounting position of the encoder strip is spaced from the guide position at which each guide member abuts and guides the carriage up to a remote region where, considering conventional arts, the encoder is hard to precisely detect in the primary scanning direction the displacement based on posture change of the carriage in use.

This is because, when the case in which the carriage driving apparatus is provided to an image forming apparatus is taken as an example, the encoder strip is liable to be stained by ink ejected from an ink head mounted to the carriage and/or lubricant applied to the guide members.

For the problem described above, a mounting member for mounting the encoder strip to the guide members may extend in the direction apart from the carriage so as to make the mounting position of the encoder strip apart from the guide position at which the guide member abuts and guides the carriage. In addition, the encoder may be disposed upward of the guide position up to the remote region where the encoder is barely able to precisely detect in the primary scanning direction the uppermost displacement based on posture change of the carriage in use.

However, it is the present state that the guide member is formed by bending a single plate member. Therefore, when the mounting member is configured so as to extend the mounting member, the guide member should be processed from a great plate member according to the increased mounting member. Therefore, a plate member having a size greater than the size of the plate member before the mounting member is extended in the direction apart from the carriage is needed, which entails increased material cost and time-consuming labor. Accordingly, the production cost for the carriage driving apparatus is increased, thus unpreferable.

In order to solve the problem described above, an object is to realize a configuration in which the mounting position of the encoder strip is apart from the guide position of the carriage, while preventing the production cost for the carriage driving apparatus from increasing.

There is provided a carriage driving apparatus according to an aspect, having a first guide member and a second guide member that extend in parallel and are adjacent to each other, and a carriage disposed between the first guide member and the second guide member that queue side by side, the carriage being capable of reciprocal movement in a extending direction of the guide members by being guided by the guide members, the carriage driving apparatus comprising: a detection strip arranged along the extending direction for detecting the position of the carriage in the extending direction; and first extending portion and second extending portion mounted respectively at one end and another end of the first guide member and extending respectively from each end so as to be perpendicular to the extending direction and a queuing direction of the guide members, the first extending portion and the second extending portion supporting the detection strip.

Further, there is provided a carriage driving apparatus according to an aspect, wherein the detection strip is arranged so as to be apart from the carriage and the first guide member in the queuing direction.

In the carriage driving apparatus thus configured, the first extending portion is formed from a plate member different from the first guide member, and the first extending portion is fixed to the first guide member, whereby the configuration for supporting one end of the encoder strip can be realized.

Specifically, as for the first guide member, the portion for supporting the encoder strip does not have to be formed upon forming the first guide member by bending a single plate member, whereby the material cost as the plate member can be held down.

The above and further objects and features will more fully be apparent from the following detailed description with accompanying drawings.

DETAILED DESCRIPTION

An embodiment will be described below with reference to drawings.

Figure 1:
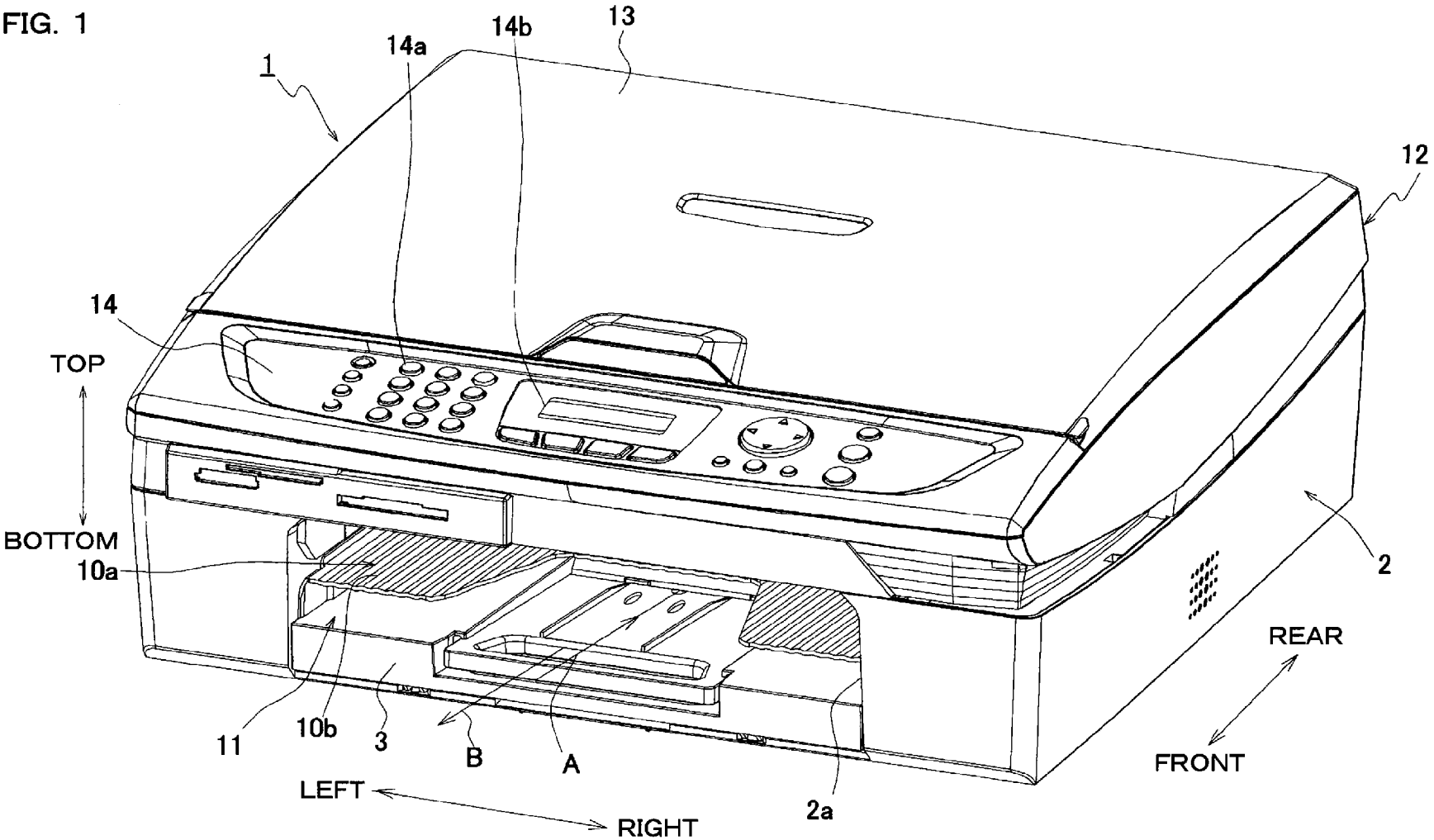
FIG. 1 is a perspective view showing an appearance of an image forming apparatus according to one embodiment.
Figure 2:
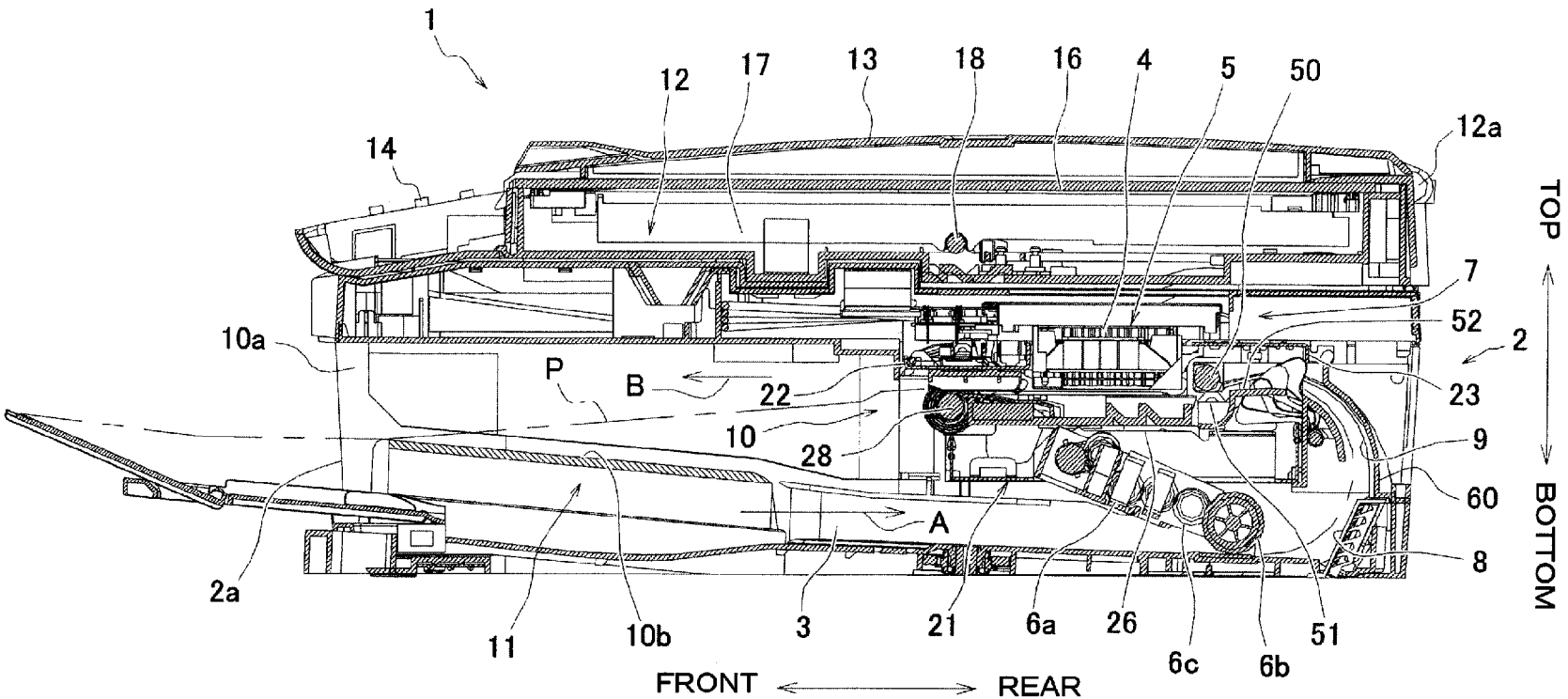
FIG. 2 is a side sectional view of the image forming apparatus according to one embodiment.

FIG. 1 is a perspective view showing an appearance of a composite machine 1 serving as an image forming apparatus according to one embodiment, and FIG. 2 is its side sectional view. In the following explanation, the top-to-bottom direction is expressed on the basis of the normal use state (the state shown in FIG. 1) of the composite machine 1, the front-to-rear direction is expressed such that the side where an operation panel section 14 described later is provided is defined as the near (front) side, and right-to-left direction is expressed as the composite machine 1 is viewed from the near side (from the front).

The composite machine 1 has a printer function, scanner function, color copy function, facsimile function, etc. As shown in FIGS. 1 and 2, an image reading device 12 used for reading a document is mounted at the top portion of a housing 2 made of a synthetic resin.

The image reading device 12 is provided to the housing 2 so as to be openable and closable about an unillustrated axis mounted to its left end portion. A document cover member 13 covering the top surface of the image reading device 12 is provided so as to be openable and closable about an axis 12*a* (see FIG. 2) mounted to its rear end portion.

As shown in FIG. 2, a placing glass plate 16 on which a document to be read is placed is mounted to the top surface of the image reading device 12 with the document cover member 13 opened in the upward direction. A contact image sensor (CIS) 17 for reading the document is provided below the placing glass plate 16 along a guide shaft 18, which extends in the direction orthogonal to the sheet surface in FIG. 2 (in the main scanning direction, or right-to-left direction), so as to be capable of making a reciprocating movement.

As shown in FIGS. 1 and 2, an operation panel section 14 provided with an operation button group 14*a* for performing an input operation or liquid display section (LCD) 14*b* for displaying various information is provided at the front of the image reading device 12.

On the other hand, a sheet feeding section 11 for feeding a recording sheet P serving as a recording medium is provided at the bottom portion of the housing 2. The sheet feeding section 11 has a sheet feeding cassette 3 that houses the stacked (accumulated) recording sheet P and is detachably mounted to the housing 2 in the front-to-rear direction through an opening 2*a* formed at the front side of the housing 2. In this illustrative example, the sheet feeding cassette 3 can stack a plurality of recording sheet P of different sizes cut to A4 size, letter size, legal size, postcard size. The sheet feeding cassette 3 stacks a plurality of cut sheets in such an orientation that the short-side of the sheet is in coincidence with the direction (main scanning direction, or right-to-left direction) which is perpendicular to the sheet feeding direction (auxiliary scanning direction, front-to-rear direction, or direction shown by an arrow A).

As shown in FIG. 2, an inclined separation plate 8 for separating the recording sheet is arranged at the rear (rear end portion) of the sheet feeding cassette 3. The inclined separation plate 8 projects at the center of the recording sheet P in the widthwise direction (right-to-left direction), and is formed into a convexly bent shape, viewed in a plane, so as to retreat toward both end portions of the recording sheet P in the widthwise direction. A serrated elastic separation pad that is in contact with the leading end edge of the recording sheet P for promoting the separation is disposed at the center of the inclined separation plate 8 in the widthwise direction of the recording sheet P.

A base portion of a sheet feeding arm 6*a* for feeding the recording sheet P from the sheet feeding cassette 3 is mounted to the sheet feeding section 11 at the side of the housing 2 so as to be capable of pivoting in the top-to-bottom direction. A rotational drive force from an unillustrated transport motor is transmitted, via a gear transmission mechanism 6*c* provided in the sheet feeding arm 6*a*, to a sheet feeding roller 6*b* mounted to the leading end portion of the sheet feeding arm 6*a*. The recording sheet P stacked in the sheet feeding cassette 3 is separated one by one and transported by the sheet feeding roller 6*b* and the aforesaid elastic separation pad of the inclined separation plate 8. The recording sheet P thus separated so as to advance along the sheet feeding direction (the direction shown by the arrow A) is fed to the recording section 7 provided above the sheet feeding cassette 3 through a feeding path 9 including a laterally U-shaped path formed in the gap between a first transport path member 60 and a second transport path member 52. The recording section 7 corresponds to the carriage driving apparatus.

The recording section 7 includes a main frame 21 having a box-like shape extending in the right-to-left direction, the upper portion of which is open, and a first guide member 22 and a second guide member 23 that are respectively supported at both right and left end portions of the main frame 21. The recording section 7 further includes a carriage 5 installed between the first guide member 22 and the second guide member 23, and an ink head 4 that ejects ink downwardly as mounted to the carriage 5.

Figure 3:
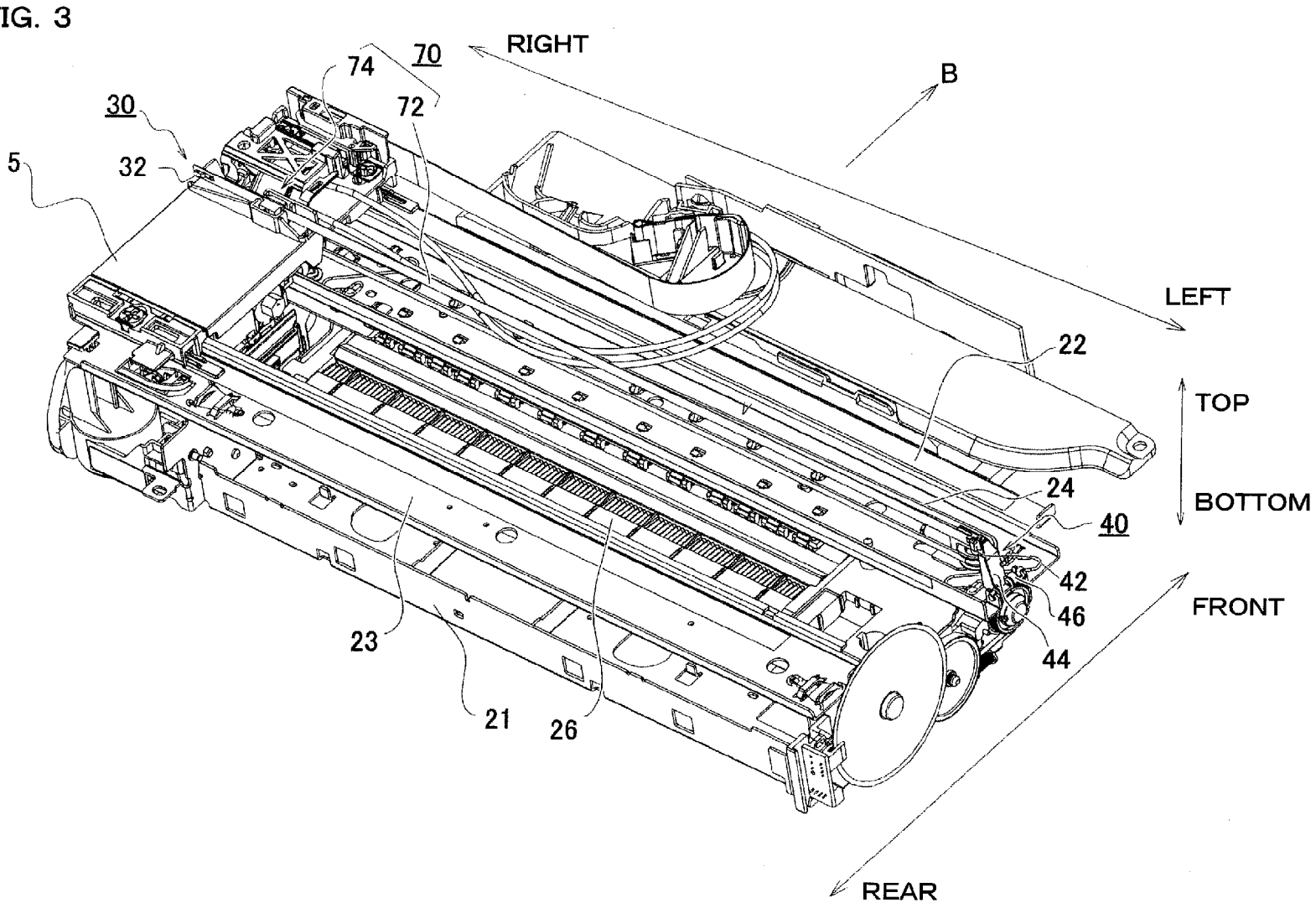
FIG. 3 is a perspective view of a recording section in the image forming apparatus according to one embodiment.

As shown in FIG. 3 that is a perspective view of the recording section 7, the first guide member 22 and the second guide member 23 are formed from a plate-like member extending respectively in the right-to-left direction. The first guide member 22 is arranged at the front side and the second guide member 23 is arranged at the rear side as spaced in the transporting direction of the recording sheet P (front-to-rear direction, or in the depth direction).

The carriage 5 is slidably supported over the first guide member 22 and the second guide member 23. The carriage 5 is capable of making a reciprocating movement with the direction in which the guide members extend defined as a main scanning direction (longitudinal direction). A timing belt 24 arranged along the main scanning direction at the top surface of the first guide member 22 is driven by an unillustrated CR (carriage) motor, whereby the carriage 5 moves in the main scanning direction.

On the other hand, at the recording section 7, a flat platen 26, which extends in the right-to-left direction and supports the recording sheet P from below so as to be opposite to the ink head 4, is fixed to the main frame 21 below the ink head 4 of the carriage 5 and between both guide members 22 and 23.

As shown in FIG. 2, a drive roller 50 and a nip roller 51 that opposes to the drive roller 50 from below are arranged at the upstream side of the platen 26 in the sheet discharging direction (in the direction shown by an arrow B), as transport (resist) rollers for transporting the recording sheet P to the top surface (lower surface of the ink head 4) of the platen 26. A discharge roller 28 that is driven for transporting the recording sheet P, which has passed through the recording section 7, toward a sheet discharging section 10 along the sheet discharging direction and a spur roller (not shown) that is opposite to the sheet discharging roller 28 and urged toward the sheet discharging roller 28 are arranged at the downstream side of the platen 26 in the sheet discharging direction (in the direction shown by an arrow B).

On the other hand, the sheet discharging section 10 to which the recording sheet P, having formed thereon an image recorded by the recording section 7, is discharged with the recorded surface is facing upward is arranged above the sheet feeding section 11. A sheet discharge port 10*a* is open as sharing the opening portion 2*a* of the housing 2 at the front. The recording sheet P discharged from the sheet discharging section 10 in the sheet discharging direction (in the direction shown by an arrow B) is accommodated, as stacked, on the sheet discharging tray 10*b* positioned at the inside of the opening portion 2*a*.

An unillustrated ink storing section is provided at the right end position at the front of the housing 2 covered by the image reading device 12. Four ink cartridges, each storing four colors (black (Bk), cyan (C), magenta (M), yellow (Y)) for full-color recording, are disposed in the ink storing section. The ink storing section is configured such that the ink cartridges are detachable with the image reading device 12 opened upwardly. The ink cartridges of each color and the aforesaid ink head 4 communicate with each other via four ink supply tubes having flexibility. The ink stored in each ink cartridge is supplied to the ink head 4 through each ink supply tube.

As shown in FIG. 3, provided at the first guide member 22 in the recording section 7 are a first extending portion 30 formed at one (right) end of the first guide member 22, a second extending portion 40 formed at the other (left) end of the first guide member 22, and a linear encoder 70 for detecting the position of the carriage 5.

Of these, the first and second extending portions 30 and 40 extend from the end portions of the first guide member 22 in the direction crossing respectively the front-to-rear direction (depth direction) and the main scanning direction (longitudinal direction) and apart from the first guide member 22 (in this embodiment, upward direction).

Figure 4A:
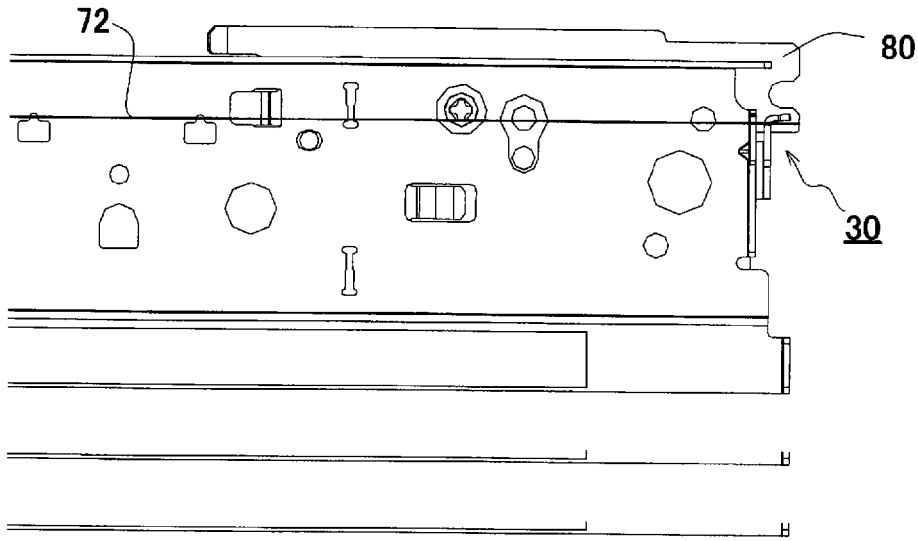
FIGS. 4A, 4B and 4C show one end of a first guide member in a carriage driving apparatus, wherein 4A is a top view, 4B is a bottom view, and 4C is a front view.
Figure 4B:
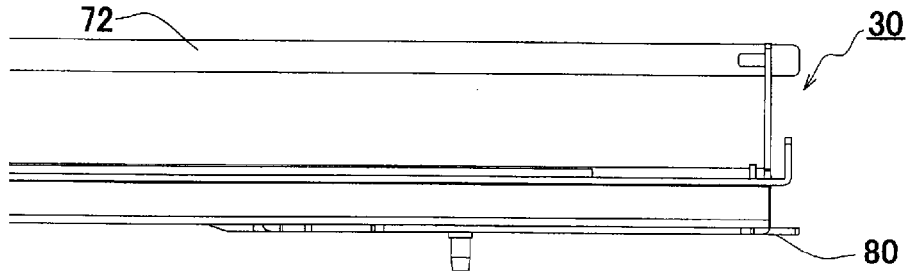
Figure 4C:
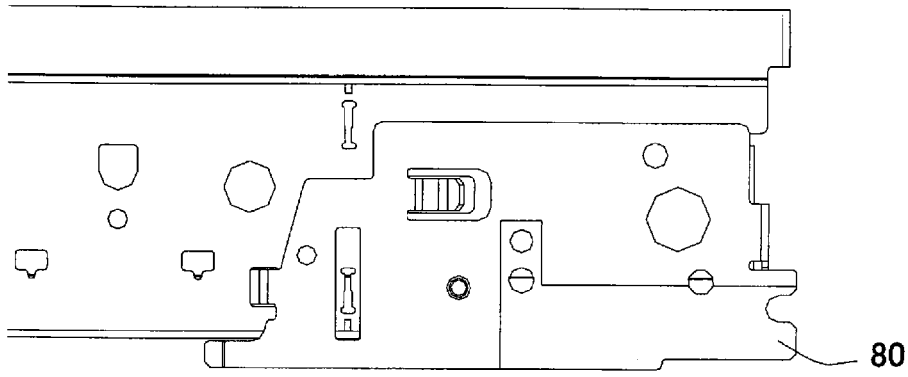

As shown in FIGS. 4A, 4B and 4C that are respectively views of one end portion of the first guide member 22 seen from top, bottom, and front, the first extending portion 30 is formed as a part of a processed plate-like member 80. In this embodiment, the plate-like member 80 having formed thereon the portion corresponding to the first extending portion 30 is bent, and the bent plate-like member 80 is fixed at one (right) end of the first guide member 22 in a positional relationship in which the portion corresponding to the first extending portion 30 extends upwardly, whereby the first extending portion 30 is formed to the first guide member 22. FIG. 4A is a view of the first guide member 22 seen from top, FIG. 4B is a view seen from front, and FIG. 4C is a view seen from bottom.

Figure 5A:
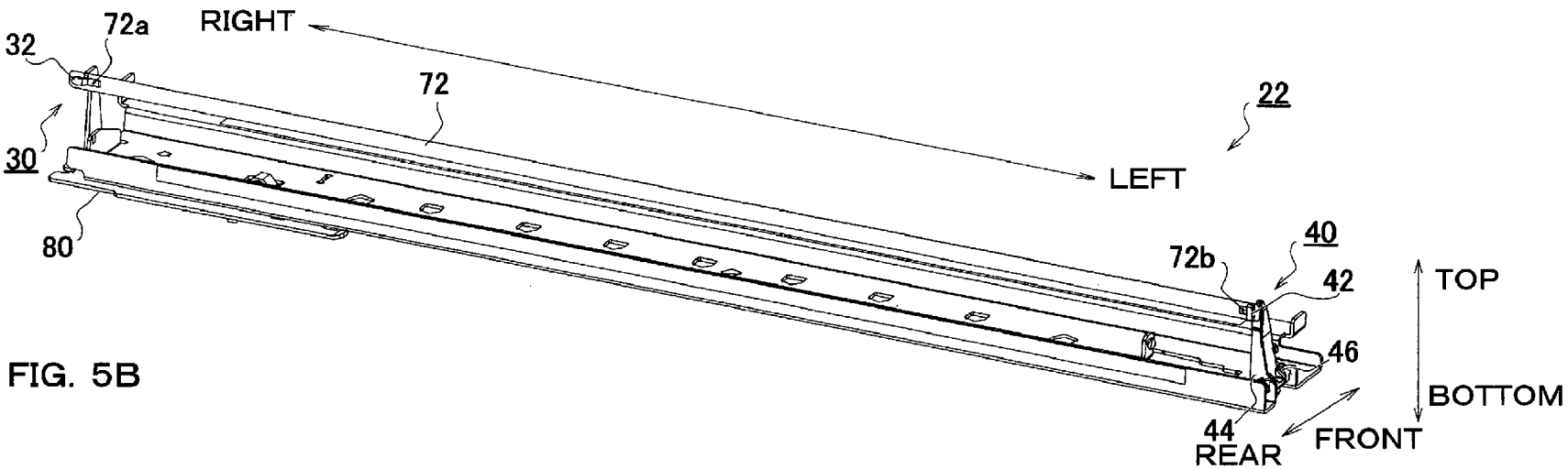
FIGS. 5A and 5B are perspective views of the first guide member in the carriage driving apparatus according to one embodiment.
Figure 5B:
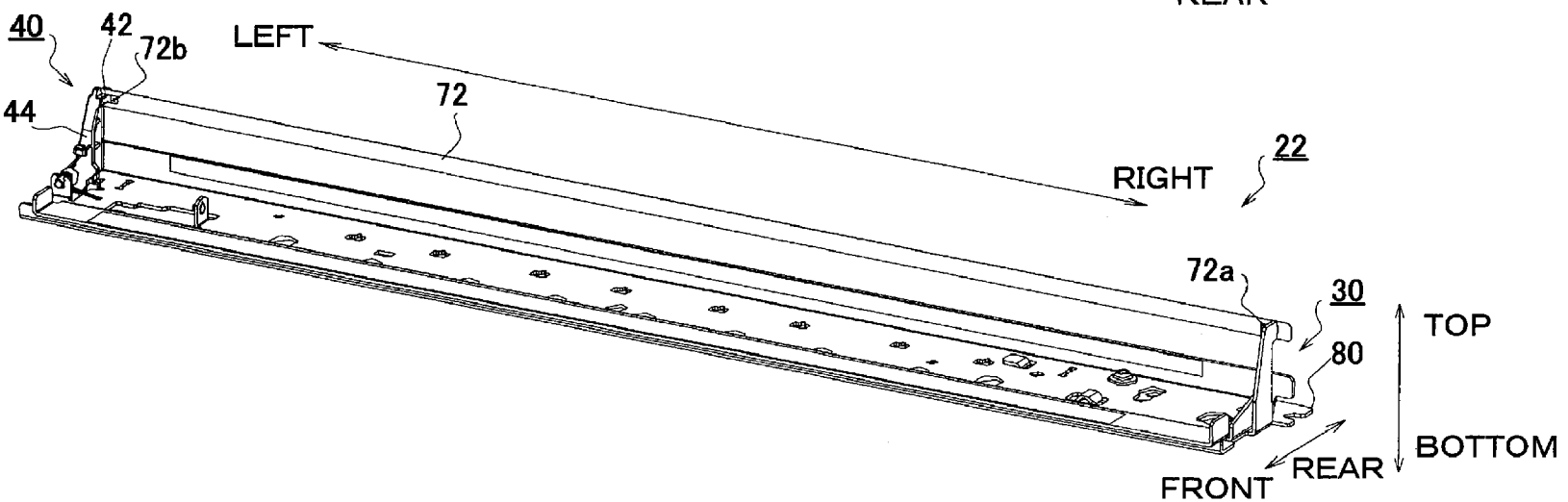

Further, as shown in FIGS. 5A and 5B that are perspective views of the first guide member 22, a projecting portion 32 is formed that projects toward the side where an encoder strip (detection strip) 72 for constituting the linear encoder 70 is arranged (in the direction from the first guide member 22 to the second guide member 23), and bent in an obtuse angle, seen in a plane (i.e., the state in which the first extending portion 30 is seen from top), on the basis of the direction in which the leading end projects. The projecting portion 32 is bent toward the first extending portion 30 from the second extending portion 40 (in the right direction).

The second extending portion 40 is mounted so as to be displaceable between a normal state in which a resinous support member 44 having a fixed length extends upwardly and an inclined state in which it inclines toward the first extending portion 30 from the normal state. The second extending portion 40 is urged toward the normal state by an urging member (helical torsion coil spring in this embodiment) 46.

The second extending portion 40 is pivotably mounted to the end portion of the first guide member 22. The second extending portion 40 may be urged by the urging member 46 toward the outer side of the first guide member 22 in the longitudinal direction so as to be held vertical to the longitudinal direction and depth direction. Further, the second extending portion 40 has the pivotable support member 44 for supporting the encoder strip 72 and the urging member 46 for urging the support member 44. The support member 44 may be urged by the urging member 46 toward the outer side of the first guide member 22 in the longitudinal direction so as to be held vertical to the longitudinal direction and depth direction.

Moreover, as shown in FIG. 5, the second extending portion 40 has formed thereto a projecting portion 42 that projects toward the side where the encoder strip 72 constituting the linear encoder 70 is arranged (toward the second guide member 23 from the first guide member 22) and has the leading end extending in the top-to-bottom direction.

As shown in FIG. 3, the linear encoder 70 is composed of the encoder strip 72 made of a band-like resinous material and a linear sensor 74 that can read a detection pattern (not shown) formed on the encoder strip 72.

Of these, both ends of the encoder strip 72 are supported by the first and second extending portions 30 and 40 in order that the encoder strip 72 is positioned parallel to the main scanning direction above the carriage 5. Hook holes (engagement holes) 72*a* and 72*b* extending in the longitudinal direction are formed at both end regions of the encoder strip (detection strip) 72 (see FIG. 5).

The projecting portions (engagement projections) 32 and 42 of the first and second extending portions 30 and 40 are hooked to (engaged with) the hook holes 72*a* and 72*b*, whereby the encoder strip 72 is supported by the first and second extending portions 30 and 40.

Therefore, the encoder strip 72 is arranged so as to be apart from the carriage 5 and the first guide member 22 in the depth direction.

Each of the projecting portions (engagement projections) 32 and 42 has a base section and leading end, wherein the cross-sectional area of the leading end in the direction generally perpendicular to the projecting direction of the projecting portions 32 and 42 may be set greater than the cross-sectional area of the base section in order to prevent the encoder strip 72 from falling off (from disengaging from) the projecting portions 32 and 42. In this case, since the projecting portions 32 and 42 are formed from a plate member, the cross-section of the base section is generally rectangular, but the cross-section of the leading end of the projecting portions 32 and 42 may be circular, elliptic, rectangular, bar-like shaped, plate-like shaped, etc. Preferably, the cross-section of the leading end of the projecting portions 32 and 42 may have elliptic shape, relatively long slender rectangular shape, or bar-like shape, similar to the shape and/or cross-section of the hook holes 72*a* and 72*b*, in order to easily engage with the hook holes (engagement holes) 72*a* and 72*b* and to easily prevent the disengagement.

The linear sensor 74 is a sensor composed of a photo-interrupter provided to the carriage 5, wherein a light-emitting device and light-receiving device are arranged above the carriage 5 so as to oppose to each other across the encoder strip 72. The linear sensor 74 detects the detection pattern of the encoder strip 72, while moving with the reciprocating movement of the carriage 5 in the main scanning direction, thereby detecting the position of the carriage 5 relative to the encoder strip 72 as the position of the carriage 5 in the main scanning direction.

In the composite machine 1 thus configured, the first guide member 22 in the recording section 7 is formed such that the first extending portion 30 is formed from a different plate-like member 80, and the configuration for supporting one end of the encoder strip 72 can be realized by fixing the first extending portion 30.

Specifically, as for the first guide member 22, since the portion for supporting the encoder strip 72 does not need to be formed upon forming the first guide member 22 from a single plate-like member by bending, the material cost for the portion for supporting the encoder strip 72 can be reduced.

Although it is necessary to process the member different from the first guide member 22, the first extending portion 30 may be formed by additionally using the plate-like member 80 that is sufficiently smaller than the first guide member 22.

Since the material cost for the plate-like member increases in proportion to the size per one member, its material cost can fully be held down, compared to the case where a plate-like member having a great size is used for processing the first guide member 22, even if the above-mentioned small plate-like member 80 is additionally used.

In this case, the first extending portion 30 formed from the plate-like member 80 is mounted to one end of the first guide member 22, so that, as shown in FIGS. 4A, 4B and 4C, the first extending portion 30 may include a region partly overlapping with one surface of the aforesaid one end of the first guide member 22. Further, since the first extending portion 30 is formed by using the plate-like member 80 that is sufficiently smaller than the first guide member 22, the area of the region of the first extending portion 30 partly overlapping with one surface of the aforesaid one end of the first guide member 22 may be formed smaller than the area of the aforesaid one surface of the above-mentioned one end of the first guide member 22.

Since the different plate-like member 80 is used for forming the first extending portion 30, it is unnecessary to consider the shape of the first extending portion 30, upon forming the first guide member 22, thus preferable. The limitation on the processing of the first extending portion 30 is more reduced than the case where the first extending portion 30 is formed in accordance with the plate-like member 80 for forming the first guide member 22, whereby the degree of freedom for its shape can be enhanced.

The support of the encoder strip 72 at the first guide member in the recording section 7 can be realized by the configuration in which the projecting portion 32 formed at the first extending portion 30 is hooked to the hook hole 72*a* formed at one end of the encoder strip 72.

Since the leading end of the projecting portion 32 is bent in an obtuse angle, seen in a plane, on the basis of the projecting direction, there is low possibility that the undesired expansion is formed at the bent portion. As a result, the encoder strip 72 is hardly supported by the expanded region, with the result that the deterioration in positioning precision of the encoder strip 72 by the projecting portion 32 can be prevented.

The end portions of the encoder strip 72 are supported respectively by the first extending portion 30 and the second extending portion 40 at the first guide member 22 in the recording section 7, whereby the support of the encoder strip 72 can be realized only by the first guide member 22.

Of these extending portions 30 and 40, the second extending portion 40 is mounted to the first guide member 22 so as to be displaceable from the normal state into the inclined state against the urging force of the urging member 46. Therefore, even if external force in the direction of inclining the second extending portion 40 is applied upon the assembly operation or maintenance, the second extending portion 40 is displaced from the normal state to the inclined state to relieve the external force, whereby the damage of the second extending portion 40 can be prevented.

Although it is necessary to process the member different from the first guide member 22, the first extending portion 30 may be formed by additionally using the plate-like member 80 that is smaller than the first guide member 22. Since the material cost for the plate-like member increases in proportion to the size per one member, its material cost can fully be held down, compared to the case where a plate-like member having a great size is used for processing the first guide member 22, even if the above-mentioned small plate-like member 80 is additionally used.

Since the different plate-like member 80 is used for forming the first extending portion 30, it is unnecessary to consider the shape of the first extending portion 30, upon forming the first guide member 22, thus preferable. The limitation on the processing of the first extending portion 30 is more reduced than the case where the first extending portion 30 is formed in accordance with the plate-like member 80 for forming the first guide member 22, whereby the degree of freedom for its shape can be enhanced.

In the above-mentioned configuration, the first extending portion may be configured to support the encoder strip, and any limitations are not particularly imposed on its specific configuration.

For example, the following configuration is possible. Specifically, a projecting portion projecting toward the region where the encoder strip is arranged, and a hook hole into which the projecting portion is hooked is formed at one end of the encoder strip, wherein the projecting portion is hooked into the hook hole.

In this configuration, it is preferable that the leading end of the projecting portion is bent with respect to the projecting direction in order to prevent the encoder strip from falling off. However, when the bending amount is increased too much, an undesired expansion might be formed at its bent portion. If the encoder strip is supported at the expanded region, the positioning precision of the encoder strip by the projecting portion is likely to deteriorate.

The carriage driving apparatus in this embodiment has the projecting portion formed so as to project from the first extending portion toward the encoder strip and to have a leading end that is bent in an obtuse angle, seen in a plane, on the basis of the projecting direction. The encoder stripe has the hook hole, formed at its one end, into which the projecting portion of the first extending portion is inserted. The hook hole is engaged with the projecting portion of the first extending portion, whereby the support of the encoder strip by the first extending portion is realized.

By virtue of this configuration, there is little chance that the undesired expansion is formed at the bent portion, since the leading end of the projecting portion is bent in an obtuse angle. As a result, the encoder stripe is difficult to be supported by the expanded region, with the result that the deterioration in the positional precision of the encoder strip by the projecting portion can be prevented.

Meanwhile, the aforesaid carriage driving apparatus is configured to support one end of the encoder strip by the first guide member. However, the other end of the encoder strip may be supported by the first guide member.

The carriage driving apparatus has the second extending portion. The second extending portion crosses respectively the direction toward the second guide member from the first guide member and the main scanning direction, and supposing that the direction apart from the first guide member is defined as a separating direction, the second extending portion is mounted at the other end of the first guide member so as to be displaceable between the normal state in which the second extending portion extends toward the separating direction from the other end and the inclined state in which the second extending portion inclines with respect to the separating direction. The second extending portion is urged toward the normal state by the urging member. The other end of the encoder strip is supported by the second extending portion.

This configuration makes it possible to support the encoder strip only by the first guide member.

Further, the second extending portion is mounted to the first guide member so as to be displaceable from the normal state to the inclined state against the urging force of the urging member. Therefore, even if external force in the direction of inclining the second extending portion is applied upon the assembly operation or maintenance, the second extending portion is displaced from the normal state to the inclined state to relieve the external force, whereby the damage of the second extending portion can be prevented.

One embodiment of an image forming apparatus may include the carriage driving apparatus. The carriage in the carriage driving apparatus has mounted thereto an ink head that can eject ink, and the image formation on the surface of a recording medium may be realized by the movement of the carriage in the main scanning direction, while ejecting ink from the ink head.

The embodiment of the present invention is described above. It is needless to say that the present invention is not limited to the aforesaid embodiment, and various modifications are possible within the technical scope of the present invention.

For example, the embodiment described above describes the case where the carriage driving apparatus according to the present invention is applied to the recording section 7 of the composite machine 1. However, the configuration of the present invention may be applied to any apparatuses involving the scanning of the carriage, other than the recording section 7 of the composite machine 1.

As this description may be embodied in several forms without departing from the spirit of essential characteristics thereof, the present embodiments are therefore illustrative and not restrictive, since the scope is defined by the appended claims rather than by description preceding them, and all changes that fall within metes and bounds of the claims, or equivalence of such metes and bounds thereof are therefore intended to be embraced by the claims.

What is claimed is:

1. A carriage driving apparatus having a first guide member and a second guide member that extend in parallel and are adjacent to each other, and a carriage disposed between the first guide member and the second guide member that queue side by side, the carriage being capable of reciprocative movement in a extending direction of the guide members by being guided by the guide members, the carriage driving apparatus comprising:

a detection strip arranged along the extending direction for detecting the position of the carriage in the extending direction; and first extending portion and second extending portion mounted respectively at one end and another end of the first guide member and extending respectively from each end so as to be perpendicular to the extending direction and a queuing direction of the guide members, the first extending portion and the second extending portion supporting the detection strip.

2. A carriage driving apparatus according to claim 1, wherein the detection strip is arranged so as to be apart from the carriage and the first guide member in the queuing direction.

3. A carriage driving apparatus according to claim 2, wherein engagement holes are formed at both end regions of the detection strip;

engagement projections are formed at the extending portions; and each of the engagement projections is engaged with a corresponding engagement hole so as to support the detection strip to the extending portions.

4. A carriage driving apparatus according to claim 3, wherein the engagement projection has a base section and an end section, wherein a cross sectional area of the end section is greater than a cross sectional area of the base section in order to prevent disengagement of the detection strip from the engagement projection.

5. A carriage driving apparatus according to claim 4, wherein the end section of the engagement projection is being bent in an obtuse angle with respect to a projecting direction of the base section of the engagement projection.

6. A carriage driving apparatus according to claim 1, wherein engagement holes are formed at both end regions of the detection strip;

engagement projections are formed at the extending portions; and each of the engagement projections is engaged with a corresponding engagement hole so as to support the detection strip to the extending portions.

7. A carriage driving apparatus according to claim 6, wherein the engagement projection has a base section and an end section, wherein a cross sectional area of the end section is greater than a cross sectional area of the base section in order to prevent disengagement of the detection strip from the engagement projection.

8. A carriage driving apparatus according to claim 6, wherein the first extending portion is a member separable from the first guide member, and is mounted at the one end of the first guide member.

9. A carriage driving apparatus according to claim 8, wherein when the first extending portion is mounted to the one end of the first guide member, the first extending portion includes a region partly overlapping with one surface of the one end.

10. A carriage driving apparatus according to claim 9, wherein an area of the region of the first extending portion is smaller than an area of the one surface of the one end of the first guide member.

11. A carriage driving apparatus according to claim 1, wherein the first extending portion is a member separable from the first guide member, and is mounted at the one end of the first guide member.

12. A carriage driving apparatus according to claim 11, wherein when the first extending portion is mounted to the one end of the first guide member, the first extending portion includes a region partly overlapping with one surface of the one end.

13. A carriage driving apparatus according to claim 12, wherein an area of the region of the first extending portion is smaller than an area of the one surface of the one end of the first guide member.

14. A carriage driving apparatus according to claim 1, wherein the second extending portion is pivotably mounted to the another end of the first guide member, and biased, by an biasing member for biasing the second extending portion, toward an outer side of the first guide member in the extending direction so as to be held perpendicular to the extending direction and the queuing direction.

15. A carriage driving apparatus according to claim 1, wherein the second extending portion has a pivotable support member for supporting the detection strip and an biasing member for biasing the support member, and the support member is biased by the biasing member toward an outer side of the first guide member in the extending direction so as to be held perpendicular to the extending direction and the queuing direction.

16. A carriage driving apparatus according to claim 1, wherein the detection strip is a band-like member on which a pattern readable by an optional sensor is formed.

17. An image forming apparatus for forming an image onto a recording medium by ejecting ink from an ink head, comprising the carriage driving apparatus as set forth in claim 1, wherein the carriage mounts the ink head thereto, and is scanned along the extending direction as causing the ink head to eject the ink onto the recording medium.

* * * * *